US011635233B2

(12) United States Patent
Hollister et al.

(10) Patent No.: US 11,635,233 B2
(45) Date of Patent: *Apr. 25, 2023

(54) COOLING SYSTEM

(71) Applicant: Heatcraft Refrigeration Products LLC, Stone Mountain, GA (US)

(72) Inventors: Mike Hollister, Atlanta, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/451,568

(22) Filed: Oct. 20, 2021

(65) Prior Publication Data

US 2022/0034564 A1 Feb. 3, 2022

Related U.S. Application Data

(63) Continuation of application No. 16/024,970, filed on Jul. 2, 2018, now Pat. No. 11,187,445.

(51) Int. Cl.
*F25B 1/10* (2006.01)
*F25B 47/02* (2006.01)
(Continued)

(52) U.S. Cl.
CPC ..... *F25B 1/10* (2013.01); *F25B 7/00* (2013.01); *F25B 41/20* (2021.01); *F25B 47/022* (2013.01);
(Continued)

(58) Field of Classification Search
CPC .... F25B 1/00; F25B 41/20; F25B 7/00; F25B 47/022; F25B 2347/022; F25B 2700/21175
See application file for complete search history.

(56) References Cited

U.S. PATENT DOCUMENTS

2007/0137238 A1* 6/2007 Hu ..... F25B 5/02 62/277
2009/0126399 A1 5/2009 Takegami
(Continued)

FOREIGN PATENT DOCUMENTS

WO 2006022829 A1 3/2006
WO 2013078088 A1 5/2013

OTHER PUBLICATIONS

European Patent Office, partial European Search Report (R. 64 EPC), Application No. 19181391.4, dated Nov. 6, 2019, 14 pages.
(Continued)

*Primary Examiner* — Miguel A Diaz
(74) *Attorney, Agent, or Firm* — Baker Botts L.L.P.

(57) ABSTRACT

A system includes a flash tank, a first load, a second load, a first compressor, a second compressor, a first valve, and a second valve. The flash tank stores a refrigerant. The first and second loads use the refrigerant to cool first and second spaces. The first compressor compresses the refrigerant from the first load during a first mode of operation and a flash gas from the flash tank during a second mode of operation. The second compressor compresses a mixture of the refrigerant from the first and second loads during the first mode of operation. The first valve directs the flash gas from the flash tank to the first compressor during the second mode of operation. The second valve directs the compressed flash gas from the first compressor to the first load during the second mode of operation to defrost the first load.

20 Claims, 5 Drawing Sheets

(51) Int. Cl.
*F25B 41/20* (2021.01)
*F25B 7/00* (2006.01)

(52) U.S. Cl.
CPC ..... *F25B 2347/022* (2013.01); *F25B 2700/21175* (2013.01)

(56) References Cited

U.S. PATENT DOCUMENTS

| | | | |
|---|---|---|---|
| 2014/0352343 | A1 | 12/2014 | Hinde et al. |
| 2016/0178244 | A1 | 6/2016 | Delventura et al. |
| 2017/0074567 | A1 | 3/2017 | Ali et al. |
| 2017/0138643 | A1 | 5/2017 | Ignatiev et al. |
| 2017/0159977 | A1 | 6/2017 | Hellmann |
| 2018/0231284 | A1 | 8/2018 | Prins et al. |
| 2018/0252442 | A1 | 9/2018 | Zha |
| 2018/0274823 | A1 | 9/2018 | Rajendiran et al. |
| 2019/0072299 | A1 | 3/2019 | Najafifard et al. |
| 2019/0203980 | A1 | 7/2019 | Cavalleri et al. |
| 2019/0368791 | A1 | 12/2019 | Zha |
| 2019/0376732 | A1 | 12/2019 | Zha |
| 2020/0003468 | A1 | 1/2020 | Hollister et al. |

OTHER PUBLICATIONS

European Patent Office, Extended European Search Report, Application No. 19181391.4, dated Feb. 12, 2020, 12 pages.

* cited by examiner

COOLING SYSTEM

CROSS-REFERENCE TO RELATED APPLICATIONS

This application is a continuation of U.S. patent application Ser. No. 16/024,970 filed Jul. 2, 2018, by Mike Hollister et al., and entitled "COOLING SYSTEM," which is incorporated herein by reference.

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

In existing systems, one way to address frost and/or ice accumulation on the load is to cycle refrigerant back to the load after the refrigerant has absorbed heat from the load. Usually, discharge from a low temperature compressor is cycled back to a low temperature load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle maintain three low temperature loads in a refrigeration cycle while defrosting one low temperature load. By maintaining a 3:1 ratio of loads in a refrigeration cycle to loads in a defrost cycle, there is sufficient refrigerant available to defrost a load.

It may not always be possible however to maintain this 3:1 ratio. For example, there may be times (e.g., at night or when a store is closed) when the system and the loads are running less frequently or less strenuously, thus resulting in less refrigerant being available to defrost a load. As another example, because each load occupies space, some stores may not have enough space available to install four or more loads. In these installations, there may not be sufficient refrigerant available to defrost even one load.

This disclosure contemplates a cooling system that can perform hot gas defrost even when the system may not be operating three times more loads in a refrigeration cycle than in a defrost cycle. To supply additional refrigerant from a defrost cycle, the cooling system directs flash gas from a flash tank and/or refrigerant from a medium temperature load to a low temperature compressor. After compression, the flash gas and/or refrigerant is directed to a load to defrost the load. In this manner, there is sufficient refrigerant to defrost the load in particular embodiments. Certain embodiments of the cooling system are described below.

According to one embodiment, a system includes a flash tank, a first load, a second load, a first compressor, a second compressor, a first valve, and a second valve. The flash tank stores a refrigerant. The first load uses the refrigerant from the flash tank to cool a first space proximate the first load. The second load uses the refrigerant form the flash tank to cool a second space proximate the second load. The first compressor compresses the refrigerant from the first load during a first mode of operation and compresses a flash gas from the flash tank during a second mode of operation. The second compressor compresses a mixture of the refrigerant from the first load and the refrigerant from the second load during the first mode of operation. The first valve closes during the first mode of operation and directs the flash gas from the flash tank to the first compressor during the second mode of operation. The second valve closes during the first mode of operation and directs the compressed flash gas from the first compressor to the first load during the second mode of operation to defrost the first load.

According to another embodiment, a system includes a flash tank, a first load, a second load, a first compressor, a second compressor, a first valve, and a second valve. The flash tank stores a refrigerant. The first load uses the refrigerant from the flash tank to cool a first space proximate the first load. The second load uses the refrigerant form the flash tank to cool a second space proximate the second load. The first compressor compresses the refrigerant from the first load during a first mode of operation and compresses the refrigerant from the second load during a second mode of operation. The second compressor compresses a mixture of the refrigerant from the first load and the refrigerant from the second load during the first mode of operation. The first valve closes during the first mode of operation and directs the refrigerant from the second load to the first compressor during the second mode of operation. The second valve closes during the first mode of operation and directs the compressed refrigerant from the first compressor to the first load during the second mode of operation to defrost the first load.

According to yet another embodiment, a method includes storing, by a flash tank, a refrigerant. During a first mode of operation, the method includes using, by a first load, the refrigerant from the flash tank to cool a first space proximate the first load, using, by a second load, the refrigerant form the flash tank to cool a second space proximate the second load, compressing, by a first compressor, the refrigerant from the first load, and compressing, by a second compressor, a mixture of the refrigerant from the first load and the refrigerant from the second load. During a second mode of operation, the method includes using, by the second load, the refrigerant form the flash tank to cool the second space proximate the second load, directing, by a first valve, a flash gas from the flash tank to the first compressor, compressing, by the first compressor, the flash gas from the flash tank, and directing, by a second valve, the compressed flash gas from the first compressor to the first load to defrost the first load.

Certain embodiments may provide one or more technical advantages. For example, an embodiment allows for sufficient refrigerant to be available to perform a defrost cycle even though the loads in the system are not operating at full capacity or frequently. As another example, an embodiment allows for a cooling system with fewer loads to perform a defrost cycle thereby reducing the space and/or footprint occupied by the cooling system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 5 of the drawings, like numerals being used for like and corresponding parts of the various drawings.

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

In existing systems, one way to address frost and/or ice accumulation on the load is to cycle refrigerant back to the load after the refrigerant has absorbed heat from the load. Usually, discharge from a low temperature compressor is cycled back to a low temperature load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle maintain three low temperature loads in a refrigeration cycle while defrosting one low temperature load. By maintaining a 3:1 ratio of loads in a refrigeration cycle to loads in a defrost cycle, there is sufficient refrigerant available to defrost a load.

It may not always be possible however to maintain this 3:1 ratio. For example, there may be times (e.g., at night or when a store is closed) when the system and the loads are running less frequently or less strenuously, thus resulting in less refrigerant being available to defrost a load. As another example, because each load occupies space, some stores may not have enough space available to install four or more loads. In these installations, there may not be sufficient refrigerant available to defrost even one load.

Figure 1:
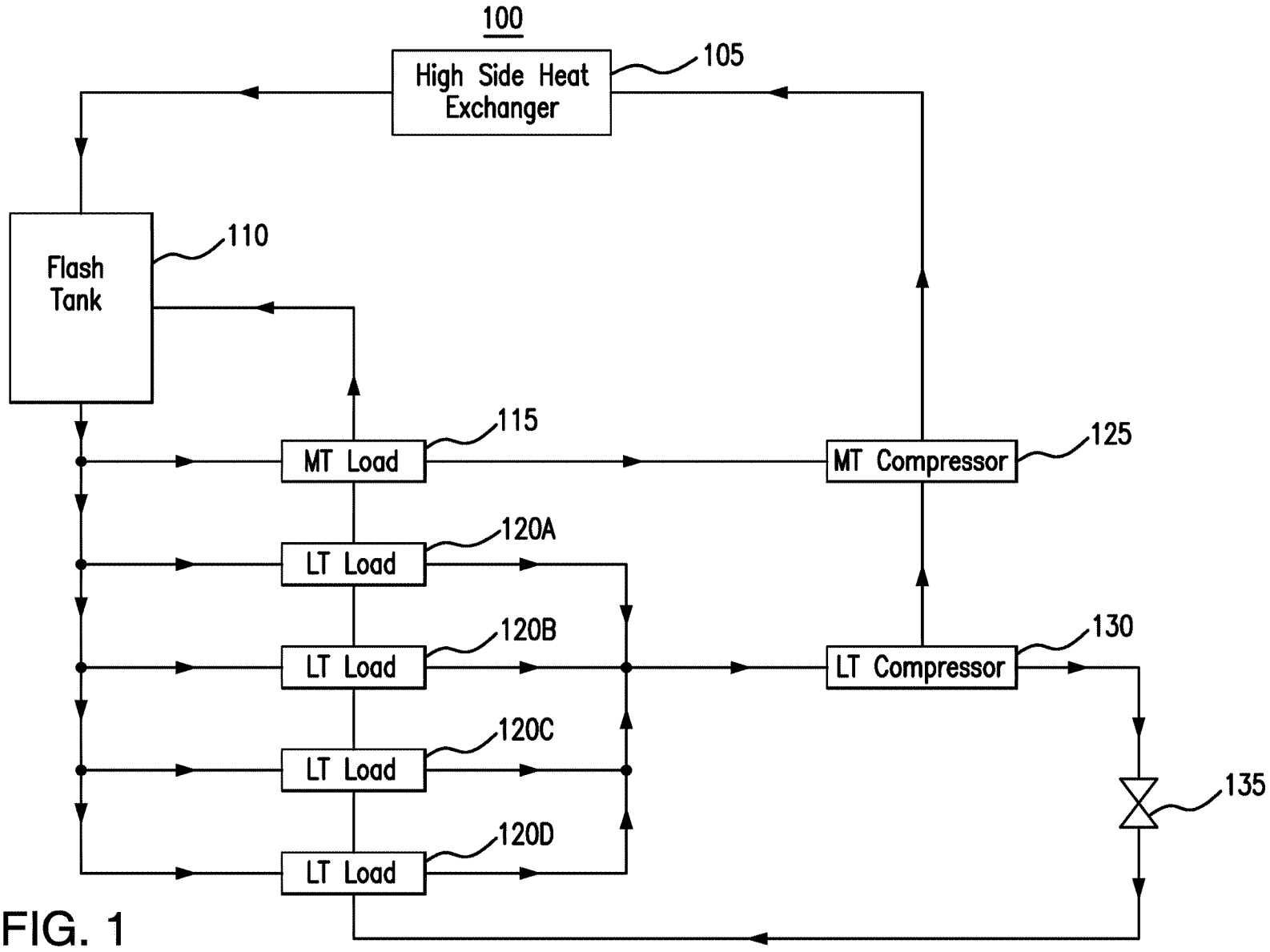
FIG. 1 illustrates an example cooling system.

This disclosure contemplates a cooling system that can perform hot gas defrost even when the system may not be operating three times more loads in a refrigeration cycle than in a defrost cycle. To supply additional refrigerant from a defrost cycle, the cooling system directs flash gas from a flash tank and/or refrigerant from a medium temperature load to a low temperature compressor. After compression, the flash gas and/or refrigerant is directed to a load to defrost the load. In this manner, there is sufficient refrigerant to defrost the load in particular embodiments. In some embodiments, the cooling system reduces the amount of refrigeration units and/or circuits needed to accommodate a defrost cycle, which reduces the size and footprint of the cooling system. In certain embodiments, the cooling system reduces the discharge temperature of a low temperature compressor, which may reduce the superheat at the low temperature compressor. In some embodiments, the cooling system allows for less restrictive load management compared to existing systems because the cooling system does not necessarily need to maintain a 3:1 load to defrost ratio. The cooling system will be described using FIGS. 1 through 5. FIG. 1 will describe an existing cooling system with hot gas defrost. FIGS. 2 through 5 describe the cooling system with improved hot gas defrost.

FIG. 1 illustrates an example cooling system 100. As shown in FIG. 1, system 100 includes a high side heat exchanger 105, a flash tank 110, a medium temperature load 115, low temperature loads 120A-120D, a medium temperature compressor 125, a low temperature compressor 130, and a valve 135. By operating valve 135, system 100 allows for hot gas to be circulated to a low temperature load 120 to defrost low temperature load 120. After defrosting low temperature load 120, the hot gas and/or refrigerant is cycled back to flash tank 110.

High side heat exchanger 105 removes heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature loads 120A-120D and medium temperature load 115. In some embodiments, a flash gas and/or a gaseous refrigerant is released from flash tank 110. By releasing flash gas, the pressure within flash tank 110 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature loads 120A-120D and medium temperature load 115. When the refrigerant reaches low temperature loads 120A-120D or medium temperature load 115, the refrigerant removes heat from the air around low temperature loads 120A-120D or medium temperature load 115. As a result, the air is cooled. The cooled air may then be circulated such as, for example, by a fan to cool a space such as, for example, a freezer and/or a refrigerated shelf. As refrigerant passes through low temperature loads 120A-120D and medium temperature load 115, the refrigerant may change from a liquid state to a gaseous state as it absorbs heat. This disclosure contemplates including any number of low temperature loads 120 and medium temperature loads 115 in any of the disclosed cooling systems.

The refrigerant cools metallic components of low temperature loads 120A-120D and medium temperature load 115 as the refrigerant passes through low temperature loads 120A-120D and medium temperature load 115. For example, metallic coils, plates, parts of low temperature loads 120A-120D and medium temperature load 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice acts as a thermal barrier. As a result, the efficiency of cooling system 100 decreases the more ice and frost that accumulates. Cooling system 100 may use heated refrigerant to defrost these metallic components.

Refrigerant flows from low temperature loads 120A-D and medium temperature load 115 to compressors 125 and 130. This disclosure contemplates the disclosed cooling systems including any number of low temperature compressors 130 and medium temperature compressors 125. Both the low temperature compressor 130 and medium temperature compressor 125 compress refrigerant to increase the pressure of the refrigerant. As a result, the heat in the refrigerant may become concentrated and the refrigerant may become a high-pressure gas. Low temperature compressor 130 compresses refrigerant from low temperature loads 120A-120D and sends the compressed refrigerant to medium temperature compressor 125. Medium temperature compressor 125 compresses a mixture of the refrigerant from low temperature compressor 130 and medium temperature load 115. Medium temperature compressor 125 then sends the compressed refrigerant to high side heat exchanger 105.

Valve 135 may be opened or closed to cycle refrigerant from low temperature compressor 130 back to a low temperature load 120. The refrigerant may be heated after absorbing heat from the other low temperature loads 120 and being compressed by low temperature compressor 130. The hot refrigerant and/or hot gas is then cycled over the metallic components of the low temperature load 120 to defrost it. Afterwards, the hot gas and/or refrigerant is cycled back to flash tank 110. There may be additional valves between low temperature compressor 130 and low temperature loads 120A-D that control to which load 120A-D is defrosted by the refrigerant coming from low temperature compressor 130. This process of cycling heated refrigerant over a low temperature load 120 to defrost it is referred to as a defrost cycle.

In existing installations, for there to be sufficient refrigerant to defrost a load (e.g., low temperature load 120A), there should be three times as many operating loads as there are loads that need defrosting. In the illustrated example of FIG. 1, heated refrigerant from three loads, 120B-D, may be used to defrost low temperature load 120A. It may not always be possible however to maintain this 3:1 ratio. For example, there may be times (e.g., at night or when a store is closed) when the system and the loads are running less frequently or less strenuously, thus resulting in less refrigerant being available to defrost a load. As another example, because each load occupies space, some stores may not have enough space available to install four or more loads. In these installations, there may not be sufficient refrigerant available to defrost even one load.

This disclosure contemplates a cooling system that can perform hot gas defrost without necessarily operating three times as many loads as defrosting loads. These cooling systems may use refrigerant from flash tank 110 and/or refrigerant from medium temperature load 115 to defrost a load. In this manner, it is possible to perform a defrost cycle even though there are not three times as many operating loads as there are defrosting loads in certain embodiments. Embodiments of the cooling system are described below using FIGS. 2-5. These figures illustrate embodiments that include a certain number of loads and compressors for clarity and readability. However, this disclosure contemplates these embodiments including any suitable number of loads and compressors.

Figure 2:
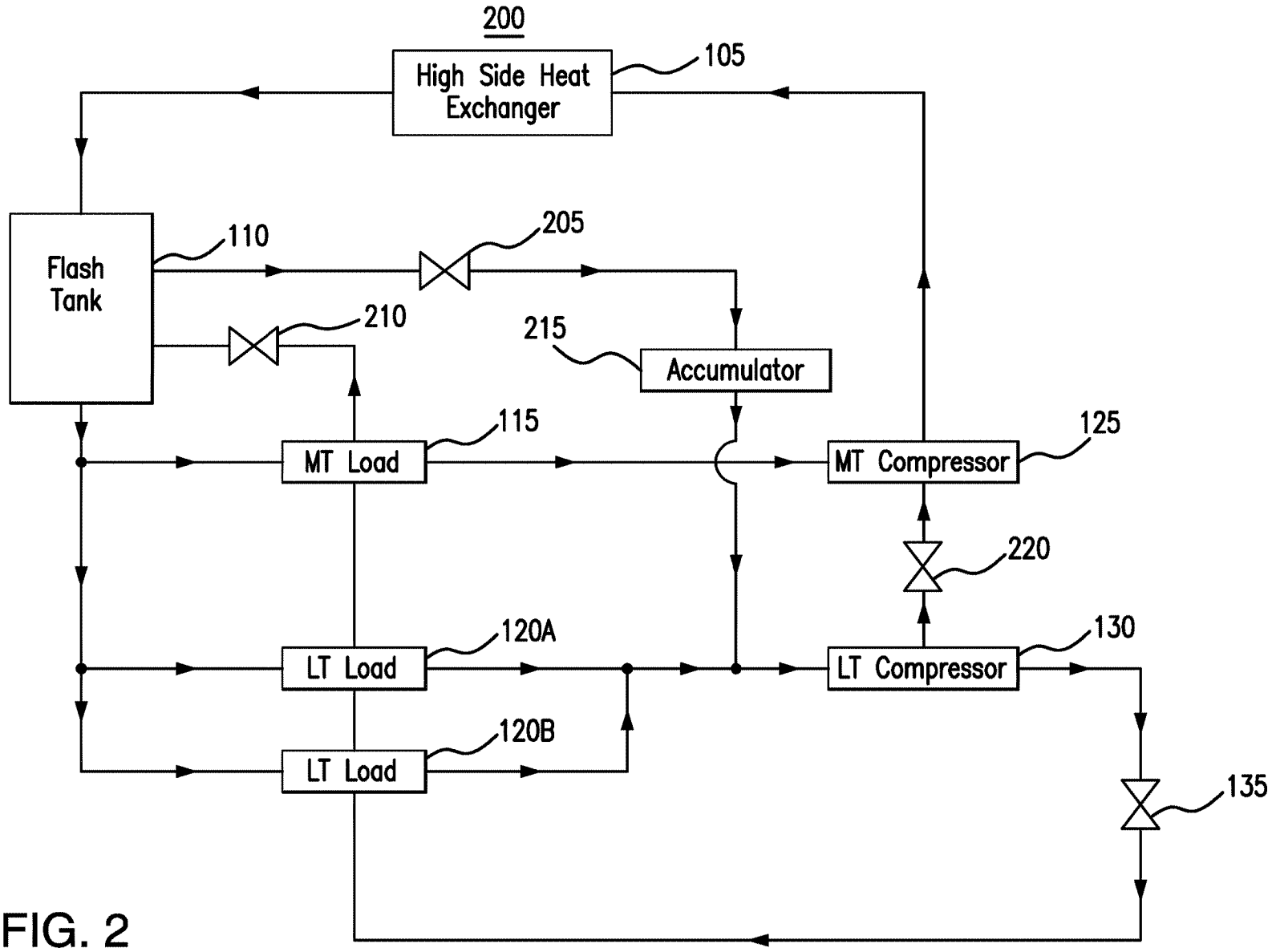
FIG. 2 illustrates an example cooling system.

FIG. 2 illustrates an example cooling system 200. As shown in FIG. 2, system 200 includes a high side heat exchanger 105, a flash tank 110, a medium temperature load 115, low temperature loads 120A and 120B, medium temperature compressor 125, low temperature compressor 130, valve 135, valve 205, valve 210, accumulator 215, and valve 220. Generally, system 200 allows a defrost cycle to be performed by using a flash gas from flash tank 110 to defrost a low temperature load 120. In certain embodiments, system 200 performs hot gas defrost even though there is an insufficient amount of refrigerant supplied by low temperature loads 120.

Generally, high side heat exchanger 105, flash tank 110, medium temperature load 115, low temperature loads 120A and 120B, medium temperature compressor 125, low temperature compressor 130, and valve 135 operate similarly as they did in system 100. For example, high side heat exchanger 105 removes heat from a refrigerant. Flash tank 110 stores the refrigerant. Medium temperature load 115, low temperature load 120A, and low temperature load 120B use the refrigerant to a cool a space proximate those loads. Low temperature compressor 130 compresses the refrigerant from low temperature loads 120A and 120B. Medium temperature compressor 125 compresses refrigerant from medium temperature load 115. These components operate together to cool a space proximate the loads. Valve 135 opens and closes to begin or end a defrost cycle.

One significant difference between system 200 and system 100 is that system 200 includes fewer low temperature loads 120 than system 100. As a result, less refrigerant is provided by low temperature loads 120 for a hot gas defrost cycle in system 200 than in system 100. As seen in the example of FIG. 2, there are not three times as many operating low temperature loads 120 than there are defrosting low temperature loads 120. As a result, the operating low temperature loads 120 do not provide a sufficient amount of refrigerant to low temperature compressor 130 and to valve 135 to defrost a low temperature load 120. For example, if low temperature load 120A is being defrosted, then the only refrigerant being supplied to low temperature compressor 130 by a low temperature load 120 is coming from low temperature load 120B. That refrigerant alone would be insufficient to defrost low temperature load 120A.

To supply additional refrigerant to defrost low temperature load 120, system 200 draws a flash gas from flash tank 110 and directs it to low temperature compressor 130. That flash gas mixes with refrigerant from the operating low temperature loads 120. That mixture is then compressed at low temperature compressor 130, and then directed by valve 135 to a low temperature load 120 that is being defrosted. In this manner, there is sufficient refrigerant to defrost a low temperature load 120 even though there may be few operating low temperature loads 120. It is generally understood that flash gas from flash tank 110 is considered a refrigerant.

Valve 205 directs flash gas from flash tank 110 to accumulator 215 and low temperature compressor 130. Valve 205 is closed during a normal refrigeration cycle and opened during a defrost cycle. When valve 205 is closed, flash gas from flash tank 110 does not flow through valve 205 to accumulator 215 and low temperature compressor 130. When valve 205 is open during a defrost cycle, flash gas from flash tank 110 flows through valve 205 to accumulator 215 and low temperature compressor 130. That flash gas mixes with refrigerant from operating low temperature loads 120 at low temperature compressor 130. After being compressed, the flash gas is then directed through valve 135 to a low temperature load 120 to defrost that low temperature load 120.

After refrigerant is used to defrost a low temperature load 120, that refrigerant is directed back to flash tank 110 through valve 210. During a normal refrigeration cycle, valve 210 is closed. During a defrost cycle, valve 210 is open. When valve 210 is closed, refrigerant does not flow through valve 210 to flash tank 110. When valve 210 is open, refrigerant that has been used to defrost a low temperature load 120 flows through valve 210 to flash tank 110.

Accumulator 215 converts a liquid portion of the flash gas from flash tank 110 from a liquid to a gas before the flash gas reaches low temperature compressor 130. Accumulator 215 receives refrigerant in the form of flash gas from flash tank 110 through valve 205. Accumulator 215 may convert any liquid portion of this received refrigerant into a gas before directing that refrigerant to low temperature compressor 130. In this manner, accumulator 215 protects low temperature compressor 130 from liquid entering (also referred to as "flooding") low temperature compressor 130. When liquid enters low temperature compressor 130, the liquid may flood and damage the compressor. By converting liquid refrigerant into gas, accumulator 215 protects low temperature compressor 130 and other components of system 200 from flooding. Certain embodiments do not include accumulator 215. In those embodiments, refrigerant (e.g., flash gas) from flash tank 110 flows directly to low temperature compressor 130 through valve 205.

Valve 220 controls the flow of refrigerant from low temperature compressor 130 to medium temperature compressor 125. In certain embodiments, valve 220 is partially closed. When a pressure of the compressed refrigerant at low temperature compressor 130 exceeds a threshold, portions of that compressed refrigerant may flow through valve 220 to medium temperature compressor 125. In this manner, an internal pressure of low temperature compressor 130 is regulated, which improves the operation and safety of low temperature compressor 130. Certain embodiments do not include valve 220. In those embodiments, refrigerant from low temperature compressor 130 can flow directly to medium temperature compressor 125.

System 200 generally operates in two different modes: a refrigeration mode/cycle and a defrost mode/cycle. During a refrigeration mode/cycle, valves 135, 205, and 210 may be closed. As a result, refrigerant flows from flash tank 110 to medium temperature load 115, low temperature load 120A and low temperature load 120B. These loads use the refrigerant to cool spaces proximate those loads. Refrigerant from low temperature loads 120A and 120B flow to low temperature compressor 130 where the refrigerant is compressed. Refrigerant from medium temperature load 115 and low temperature compressor 130 flow to medium temperature compressor 125. That mixture is compressed by medium temperature compressor 125 and directed to high side heat exchanger 105. After high side heat exchanger 105 removes heat from that refrigerant, the refrigerant is directed back to flash tank 110.

During a defrost cycle, valves 135, 205, and 210 are opened. A valve that supplies refrigerant to a low temperature load 120 that is to be defrosted is closed to stop that low temperature load 120. If low temperature load 120A is to be defrosted, then a supply valve for low temperature load 120A may be closed so that refrigerant from flash tank 110 stops flowing to low temperature load 120A. Refrigerant flows from flash tank 110 to other operating low temperature loads 120, such as for example, low temperature load 120B. Refrigerant from the operating low temperature loads 120 flows to low temperature compressor 130. A flash gas from flash tank 110 flows through valve 205 to accumulator 215 and/or low temperature compressor 130. As a result, additional refrigerant in the form of flash gas is provided for defrost. After the flash gas and the refrigerant is compressed at low temperature compressor 130, that compressed mixture is directed through valve 135 to a low temperature load 120 that is to be defrosted, such as for example, low temperature load 120A. Load 120 is then defrosted. The refrigerant and/or flash gas is then directed through valve 210 back to flash tank 110. In this manner, system 200 is able to perform a hot gas defrost cycle even though there are not three times as many operating low temperature loads 120 than defrosting low temperature loads 120.

Figure 3:
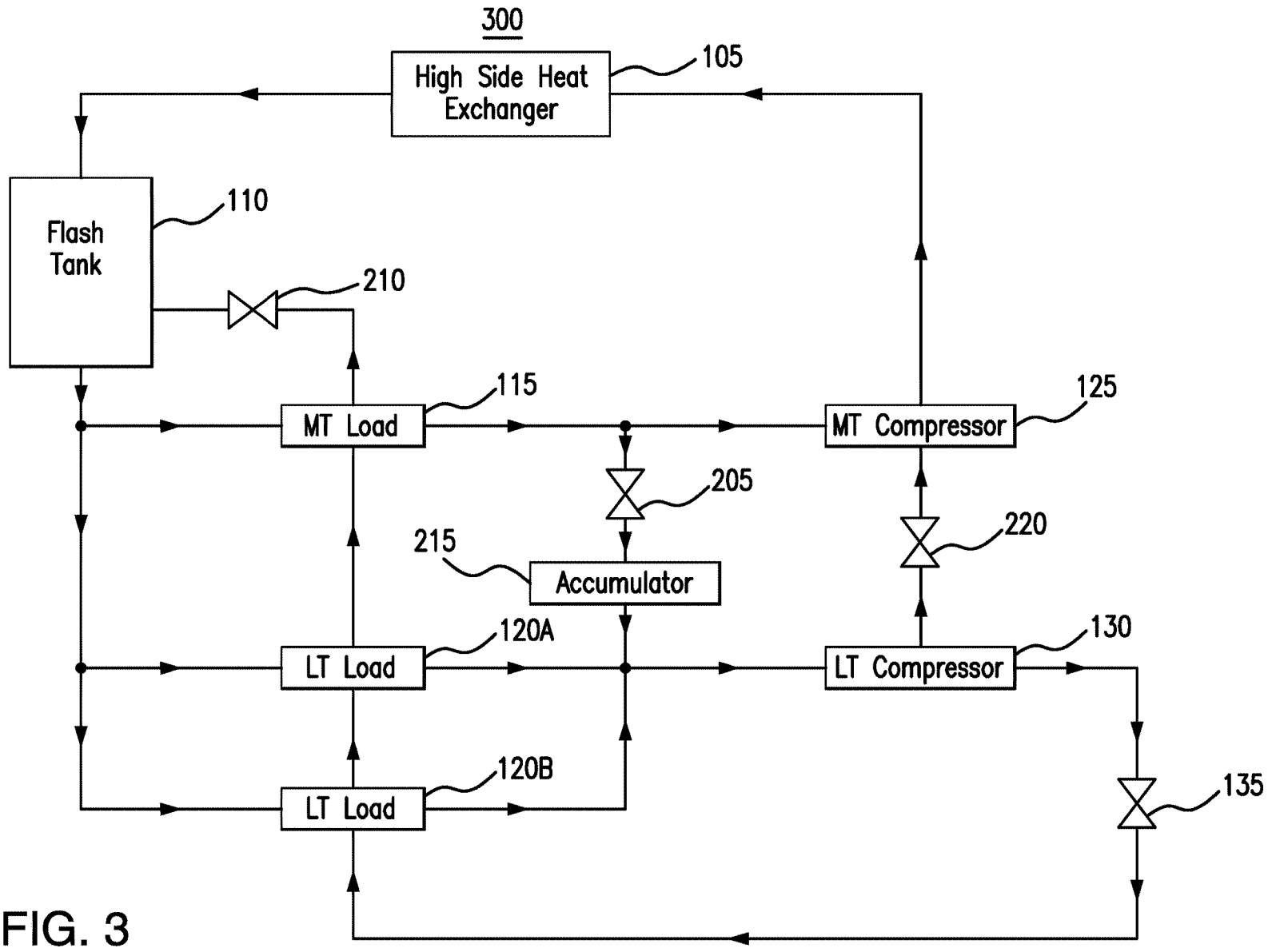
FIG. 3 illustrates an example cooling system.

FIG. 3 illustrates an example cooling system 300. As shown in FIG. 3, system 300 includes a high side heat exchanger 105, a flash tank 110, a medium temperature load 115, low temperature loads 120A and 120B, medium temperature compressor 125, low temperature compressor 130, valve 135, valve 205, valve 210, accumulator 215, and valve 220. Generally, system 300 draws refrigerant from medium temperature load 115 to supply refrigerant for a defrost cycle. In this manner, system 300 can perform a defrost cycle, even though there are not three times as many operating low temperature loads 120 than there are defrosting low temperature loads 120.

Generally, high side heat exchanger 105, flash tank 110, medium temperature load 115, low temperature loads 120A and 120B, medium temperature compressor 125, low temperature compressor 130, and valve 135 operate similarly to how they did in system 100. For example, high side heat exchange 105 removes heat from a refrigerant. Flash tank 110 stores the refrigerant. Medium temperature load 115, low temperature load 120A, and low temperature load 120B use the refrigerant to cool spaces proximate those loads. Low temperature compressor 130 compresses the refrigerant from low temperature loads 120A and 120B. Medium temperature compressor 125 compresses refrigerant from medium temperature load 115. These components operate together to cool a space proximate the loads.

One significant difference between system 300 and system 200 is the position of valve 205. In system 200, valve 205 directed refrigerant in the form of flash gas from flash tank 110 to low temperature compressor 130 during a defrost cycle. In system 300, valve 205 is positioned to direct a refrigerant from medium temperature load 115 to low temperature compressor 130. As a result, in system 300, the supply of refrigerant for the defrost cycle is partially supplied by medium temperature load 115. The refrigerant from medium temperature load 115 allows system 300 to perform a defrost cycle even though there are not three times as many operating low temperature loads 120 than there are defrosting low temperature loads 120. In some embodiments, system 300 includes a line from flash tank 110 that directs flash gas from flash tank 110 through valve 205. The line may include a separate valve (e.g., an expansion valve) that controls the flow of flash gas through the line.

Valve 205 is positioned between medium temperature load 115 and low temperature compressor 130. During a refrigeration cycle, valve 205 is closed. During a defrost cycle, valve 205 is open. When valve 205 is closed, refrigerant from medium temperature load 115 does not flow through valve 205 to low temperature compressor 130. When valve 205 is opened, refrigerant from low temperature load 115 flows through valve 205 to accumulator 215 and/or low temperature compressor 130. That refrigerant mixes with refrigerant from operating low temperature loads 120. After the refrigerant is compressed by low temperature compressor 130, the refrigerant is directed through valve 135 to defrost a low temperature load 120.

Valve 210 operates similarly as it did in system 200. During a refrigeration cycle, valve 210 is closed to prevent refrigerant from flowing back to flash tank 110. During a defrost cycle, valve 210 is open to direct refrigerant used during the defrost cycle back to flash tank 110.

Accumulator 215 converts a liquid portion of the refrigerant from medium temperature load 115 from a liquid to a gas before that refrigerant reaches low temperature compressor 130. Accumulator 215 receives refrigerant from medium temperature load 115 through valve 205. Accumulator 215 may convert any liquid portion of this received refrigerant into a gas before directing that refrigerant to low temperature compressor 130. In this manner, accumulator 215 protects low temperature compressor 130 from liquid entering (also referred to as "flooding") low temperature compressor 130. When liquid enters low temperature compressor 130, the liquid may flood and damage the compressor. By converting liquid refrigerant into gas, accumulator 215 protects low temperature compressor 130 and other components of system 200 from flooding. Certain embodiments do not include accumulator 215. In those embodiments, refrigerant from medium temperature load 115 flows directly to low temperature compressor 130 through valve 205.

Valve 220 operates similarly as it did in system 200. Valve 220 may be partially closed such that valve 220 allows refrigerant to flow from low temperature compressor 130 to medium temperature compressor 125 when an internal pressure of low temperature compressor 130 exceeds a threshold. In this manner, the internal pressure of low temperature compressor 130 may be regulated. Certain embodiments do not include valve 220. In those embodiments, refrigerant from low temperature compressor 130 can flow directly to medium temperature compressor 125.

System 300 generally operates in two different modes: a refrigeration mode/cycle and a defrost mode/cycle. During a refrigeration mode/cycle, valves 135, 205, and 210 may be closed. As a result, refrigerant flows from flash tank 110 to medium temperature load 115, low temperature load 120A, and low temperature load 120B. These loads use the refrigerant to cool spaces proximate those loads. Refrigerant from low temperature loads 120A and 120B flow to low temperature compressor 130 where the refrigerant is compressed. Refrigerant from medium temperature load 115 and low temperature compressor 130 flow to medium temperature compressor 125. That mixture is compressed by medium temperature compressor 125 and directed to high side heat exchanger 105. After high side heat exchanger 105 removes heat from that refrigerant, the refrigerant is directed back to flash tank 110.

During a defrost cycle, valves 135, 205, and 210 are opened. A valve that supplies refrigerant to a low temperature load 120 that is to be defrosted is closed to stop that low temperature load 120. If low temperature load 120A is to be defrosted, then a supply valve for low temperature load 120A may be closed so that refrigerant from flash tank 110 stops flowing to low temperature load 120A. Refrigerant flows from flash tank 110 to other operating low temperature loads 120, such as for example, low temperature load 120B. Refrigerant from the operating low temperature loads 120 flows to low temperature compressor 130. Refrigerant from medium temperature load 115 flows through valve 205 to accumulator 215 and/or low temperature compressor 130. As a result, additional refrigerant is provided for defrost. After the refrigerant is compressed at low temperature compressor 130, that refrigerant is directed through valve 135 to a low temperature load 120 that is to be defrosted, such as for example, low temperature load 120A. Load 120 is then defrosted. The refrigerant is then directed through valve 210 back to flash tank 110. In this manner, system 200 is able to perform a hot gas defrost cycle even though there are not three times as many operating low temperature loads 120 than defrosting low temperature loads 120.

Figure 4:
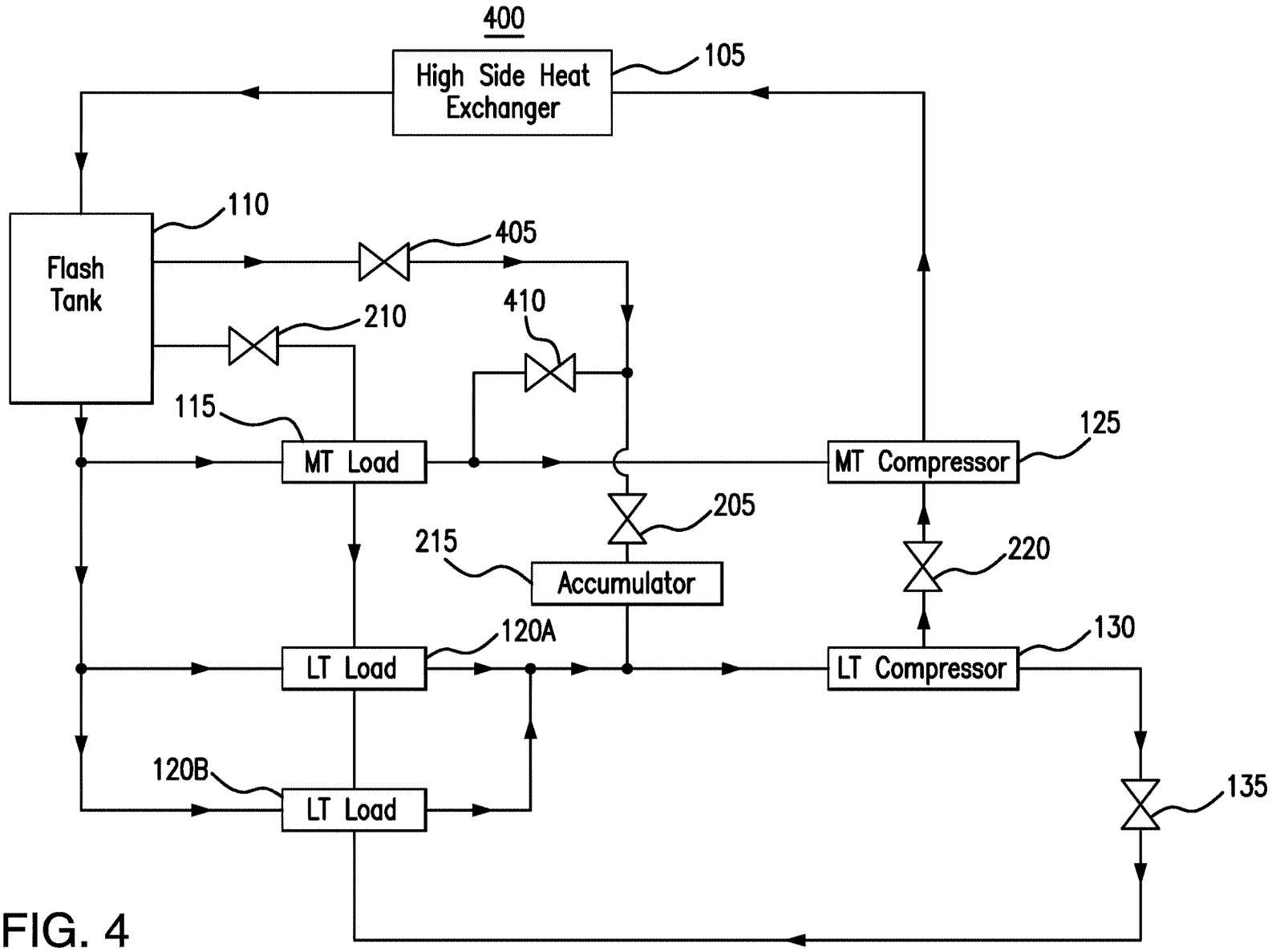
FIG. 4 illustrates an example cooling system.

FIG. 4 illustrates and example cooling system 400. As shown in FIG. 4, system 400 includes a high side heat exchanger 105, a flash tank 110, a medium temperature load 115, low temperature loads 120A and 120B, medium temperature compressor 125, low temperature compressor 130, valve 135, valve 205 valve 210 accumulator 215, valve 220, valve 405, and valve 410. Generally, system 400 uses a flash gas from flash tank 110 and refrigerant from medium temperature load 115 to perform a defrost cycle. As a result, system 400 is able to perform a defrost cycle even though there are not three times as many operating low temperature loads 120 than there are defrosting temperature loads 120 in certain embodiments.

Generally, high side heat exchanger 105, flash tank 110, medium temperature load 115, low temperature loads 120A and 120B, medium temperature compressor 125, low temperature compressor 130, and valve 135 operate similarly to how they did in system 100. For example, high side heat exchange 105 removes heat from a refrigerant. Flash tank 110 stores the refrigerant. Medium temperature load 115, low temperature load 120A, and low temperature load 120B use the refrigerant to cool spaces proximate those loads. Low temperature compressor 130 compresses the refrigerant from low temperature loads 120A and 120B. Medium temperature compressor 125 compresses refrigerant from medium temperature load 115. These components operate together to cool a space proximate the loads.

One significant difference between system 400 and system 300 is the ability to use flash gas from flash tank 110 in addition to the refrigerant from medium temperature load 115 in the defrost cycle. Valves 405 and 410 control the flow of flash gas from flash tank 110 and refrigerant from medium temperature load 115, respectively, into valve 205. As a result, the amount of flash gas and the amount of refrigerant from medium temperature load 115 can be independently controlled as supplies for the defrost cycle.

Valve 405 is positioned between flash tank 110 and valve 205. During a refrigeration cycle, valve 405 is closed. During a defrost cycle, valve 405 is open. When valve 405 is closed, flash gas from flash tank 110 does not flow through valve 405 to valve 205. When valve 405 is open, flash gas from flash tank 110 flows through valve 405 to valve 205. This disclosure contemplates valve 405 being any suitable valve such as, for example, a ball valve or a throttle valve. Valve 405 may be opened more to allow more flash gas to flow through valve 405.

Valve 410 is positioned between medium temperature load 115 and valve 205. During a refrigeration cycle, valve 410 is closed. During a defrost cycle, valve 410 is open. When valve 410 is closed, refrigerant from medium temperature load 115 does not flow through valve 410 to valve 205. When valve 410 is open, refrigerant from medium temperature load 115 flows through valve 410 to valve 205. This disclosure contemplates valve 410 being any suitable valve such as, for example, a ball valve or a throttle valve. Valve 410 may be opened more to allow more refrigerant to flow through valve 410.

The amount of flash gas from flash tank 110 and the amount of refrigerant from medium temperature load 115 flowing through valves 405 and 410, respectively, to valve 205 is controlled by valves 405 and 410. These amounts can be adjusted to control the superheat in the refrigerant reaching low temperature compressor 130. In this manner, both flash gas from flash tank 110 and refrigerant from medium temperature load 115 can be used to supply refrigerant for the defrost cycle.

Valve 205, accumulator 215, valve 210, and valve 220 operate similarly as they did in systems 200 and 300. Valve 205 opens during a defrost cycle to supply additional refrigerant to low temperature compressor 130. Accumulator 215 converts a liquid portion of the refrigerant from valve 205 from a liquid to a gas. Valve 210 directs the refrigerant used to defrost a low temperature load 120 back to flash tank 110. Valve 220 controls the flow of refrigerant from the low temperature compressor 130 to medium temperature compressor 125. Certain embodiments of system 400 may not include accumulator 215 and/or valve 220.

System 400 operates in two different modes: a refrigeration cycle and a defrost cycle. During the refrigeration cycle, valves 135, 205, 210, 405, and 410 are closed. Refrigerant flows from flash tank 115 and low temperature loads 120A and 120B to low temperature compressor 130, where it is compressed. Refrigerant from medium temperature load 115 and low temperature compressor 130 flows to medium temperature compressor 125 where they are compressed. The compressed refrigerant from medium temperature compressor 125 flows to high side heat exchanger 105, where heat is removed from the refrigerant. High side heat exchanger 105 then directs the refrigerant back to flash tank 110.

During the defrost cycle, valves 135, 205, 210, 405, and 410 open. Additionally, a supply valve to a low temperature load 120 that is being defrosted closes to shut off the supply of refrigerant to that load. Flash gas flows from flash tank 110 through valve 405 to valve 205. Additionally, refrigerant from medium temperature load 115 flows through valve 410 to valve 205. The flash gas in the refrigerant at valve 205 flows through accumulator 215 to low temperature compressor 130. Additionally, any refrigerant from operating low temperature loads 120 flows to low temperature compressor 130. After low temperature compressor 130 compresses the flash gas and the refrigerant, low temperature compressor 130 directs that compressed mixture to valve 135. That mixture then flows to a defrosting low temperature load 120 to defrost a load. After defrosting the load, that mixture flows through valve 210 back to flash tank 110. In this manner, system 400 is able to perform a defrost cycle even though there are not three times as many operating low temperature loads that there are defrosting low temperature loads 120.

Figure 5:
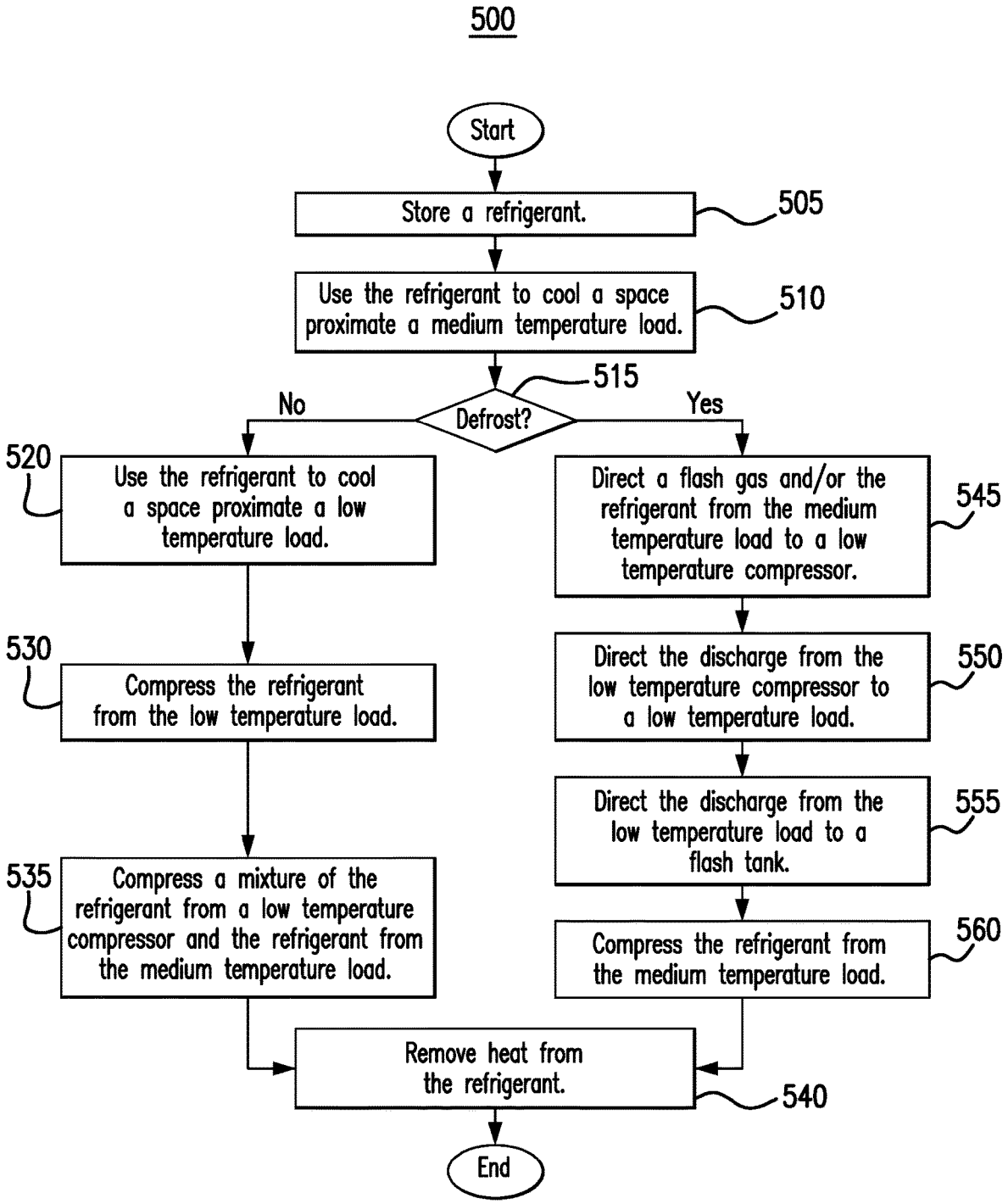
FIG. 5 is a flowchart illustrating a method of operating an example cooling system.

FIG. 5 is a flow chart showing a method 500 of operating an example cooling system. In particular embodiments, various components of systems 200, 300, and/or 400 preform the step of method 500. By performing method 500, systems 200, 300, and/or 400 are able to perform a defrost cycle even though there are not three times as many operating low temperature loads as there are defrosting low temperature loads.

A flash tank begins by storing a refrigerant in step 505. In step 510, a medium temperature load uses a refrigerant to cool a space proximate to medium temperature load.

In step 515, systems 200, 300, and 400, determine whether a defrost cycle should be started to defrost a load. If a defrost cycle should be started, a valve 205 opens to direct a flash gas and/or the refrigerant from the medium temperature load to a low temperature compressor in step 545. In step 550, the low temperature compressor directs the discharge from the low temperature compressor to a low temperature load. The discharge is then used to defrost the low temperature load. A valve 210 then directs the discharge from the low temperature load to the flash tank in step 555. In step 560, a medium temperature compressor compresses the refrigerant from the medium temperature load. Then in step 540, a high side heat exchanger removes heat from the refrigerant.

If a defrost cycle should not be started, then a refrigeration cycle commences. In step 520, a low temperature load uses the refrigerant to a cool a space proximate the low temperature load. In step 530, a low temperature compressor compresses the refrigerant from the low temperature load. A medium temperature compressor then compresses a mixture of the refrigerant from the low temperature compressor and the refrigerant from the medium temperature load in step 545. The high side heat exchanger then removes heat from the refrigerant in step 540.

Modifications, additions, or omissions may be made to method 500 depicted in FIG. 5. Method 500 may include more, fewer, or other steps. For example, steps may be performed in parallel or in any suitable order. While discussed as systems 200, 300, and/or 400 (or components thereof) performing the steps, any suitable component of systems 200, 300, and/or 400 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a flash tank configured to store a refrigerant;

a first load configured to use the refrigerant from the flash tank to cool a first space proximate the first load;

a second load configured to use the refrigerant from the flash tank to cool a second space proximate the second load during a first mode of operation and a second mode of operation;

a first compressor configured to:

compress the refrigerant from the first load during the first mode of operation; and compress a flash gas from the flash tank during the second mode of operation;

a second compressor configured to compress a mixture of the refrigerant from the first compressor and the refrigerant from the second load during the first mode of operation;

a first valve configured to:

close during the first mode of operation; and direct the flash gas from the flash tank to the first compressor during the second mode of operation; and a second valve configured to:

close during the first mode of operation; and direct the compressed flash gas from the first compressor to the first load during the second mode of operation to defrost the first load.

2. The system of claim 1, wherein the first valve is further configured to direct the refrigerant from the second load to the first compressor during the second mode of operation.

3. The system of claim 1, further comprising a third valve configured to direct a portion of the refrigerant from the first compressor to the second compressor.

4. The system of claim 1, further comprising a third load configured to use the refrigerant from the flash tank to cool a third space proximate the third load, the first compressor configured to compress the refrigerant from the third load, the second valve further configured to direct the refrigerant from the third load and compressed by the first compressor to the first load during the second mode of operation to defrost the first load.

5. The system of claim 1, further comprising a high side heat exchanger disposed between the second compressor and the flash tank and configured to remove heat from the refrigerant discharged from the second compressor.

6. The system of claim 1, further comprising an accumulator configured to convert a liquid portion of the flash gas into gas before the flash gas reaches the first compressor during the second mode of operation.

7. The system of claim 1, further comprising a third valve configured to direct the flash gas from the first load to the flash tank during the second mode of operation.

8. A system comprising:

a flash tank configured to store a refrigerant;

a first load configured to use the refrigerant from the flash tank to cool a first space proximate the first load;

a second load configured to use the refrigerant from the flash tank to cool a second space proximate the second load;

a first compressor configured to:

compress the refrigerant from the first load during a first mode of operation; and compress the refrigerant from the second load during a second mode of operation;

a second compressor configured to compress a mixture of the refrigerant from the first compressor and the refrigerant from the second load during the first mode of operation;

a first valve disposed between the second load and the first compressor, configured to:

close during the first mode of operation; and direct the refrigerant from the second load to the first compressor during the second mode of operation; and a second valve configured to:

close during the first mode of operation; and direct the compressed refrigerant from the first compressor to the first load during the second mode of operation to defrost the first load.

9. The system of claim 8, wherein the first valve is further configured to direct a flash gas from the flash tank to the first compressor during the second mode of operation.

10. The system of claim 8, further comprising a third valve configured to direct a portion of the refrigerant from the first compressor to the second compressor.

11. The system of claim 8, further comprising a third load configured to use the refrigerant from the flash tank to cool a third space proximate the third load, the first compressor configured to compress the refrigerant from the third load, the second valve further configured to direct the refrigerant from the third load and compressed by the first compressor to the first load during the second mode of operation to defrost the first load.

12. The system of claim 8, further comprising a high side heat exchanger disposed between the second compressor and the flash tank and configured to remove heat from the refrigerant discharged from the second compressor.

13. The system of claim 8, further comprising an accumulator configured to convert a liquid portion of the refrigerant from the second load before the refrigerant from the second load reaches the first compressor during the second mode of operation.

14. The system of claim 8, further comprising a third valve configured to direct the refrigerant used to defrost the first load to the flash tank during the second mode of operation.

15. A method comprising:

storing, by a flash tank, a refrigerant;

during a first mode of operation:

using, by a first load, the refrigerant from the flash tank to cool a first space proximate the first load;

using, by a second load, the refrigerant from the flash tank to cool a second space proximate the second load;

compressing, by a first compressor, the refrigerant from the first load; and compressing, by a second compressor, a mixture of the refrigerant from the first compressor and the refrigerant from the second load; and during a second mode of operation:

using, by the second load, the refrigerant from the flash tank to cool the second space proximate the second load;

directing, by a first valve disposed between the second load and the first compressor, a flash gas from the flash tank to the first compressor;

compressing, by the first compressor, the flash gas from the flash tank before the flash gas returns to the flash tank; and directing, by a second valve, the compressed flash gas from the first compressor to the first load to defrost the first load.

16. The method of claim 15, further comprising directing, by the first valve, the refrigerant from the second load to the first compressor during the second mode of operation.

17. The method of claim 15, further comprising directing, by a third valve, a portion of the refrigerant from the first compressor to the second compressor.

18. The method of claim 15, further comprising:

using, by a third load, the refrigerant from the flash tank to cool a third space proximate the third load;

compressing, by the first compressor, the refrigerant from the third load; and directing, by the second valve, the refrigerant from the third load and compressed by the first compressor to the first load during the second mode of operation to defrost the first load.

19. The method of claim 15, further comprising converting, by an accumulator, a liquid portion of the flash gas into gas before the flash gas reaches the first compressor during the second mode of operation.

20. The method of claim 15, further comprising directing, by a third valve, the flash gas from the first load to the flash tank during the second mode of operation.

* * * * *